US007673854B2

(12) United States Patent
Brouwer et al.

(10) Patent No.: US 7,673,854 B2
(45) Date of Patent: Mar. 9, 2010

(54) FOAM FORMING UNIT

(75) Inventors: Markus Franciscus Brouwer, Heesch (NL); Johannes Hubertus Josef Maria Kelders, Drunen (NL)

(73) Assignee: MeadWestvaco Calmar Netherlands B.V. (NL)

( * ) Notice: Subject to any disclaimer, the term of this patent is extended or adjusted under 35 U.S.C. 154(b) by 870 days.

(21) Appl. No.: 10/545,087

(22) PCT Filed: Feb. 10, 2004

(86) PCT No.: PCT/NL2004/000096

§ 371 (c)(1),
(2), (4) Date: Jul. 21, 2006

(87) PCT Pub. No.: WO2004/069418

PCT Pub. Date: Aug. 19, 2004

(65) Prior Publication Data

US 2007/0023933 A1 Feb. 1, 2007

(30) Foreign Application Priority Data

Feb. 10, 2003 (NL) ..... 1022633

(51) Int. Cl.
*B01F 3/04* (2006.01)

(52) U.S. Cl. ..... 261/28; 261/100; 261/DIG. 26

(58) Field of Classification Search ..... 261/28, 261/100, DIG. 26
See application file for complete search history.

(56) References Cited

U.S. PATENT DOCUMENTS 3,388,868 A * 6/1968 Watson et al. ..... 239/427
3,428,985 A * 2/1969 Boyd ..... 15/50.3
3,447,754 A * 6/1969 Egon ..... 239/343
4,603,812 A * 8/1986 Stoesser et al. ..... 239/329
5,015,370 A * 5/1991 Fricano ..... 210/138
5,219,102 A * 6/1993 Wright ..... 222/190

FOREIGN PATENT DOCUMENTS

EP 0 613 728 B1 9/1994
EP 1 199 105 B1 4/2002

OTHER PUBLICATIONS

International Search Report (PCT/ISA/210), Jul. 2004.
International Preliminary Examination Report (PCT/IPEA/409), May 2005.

* cited by examiner

*Primary Examiner*—Scott Bushey

(57) ABSTRACT

A foam-forming unit is disclosed. The foam-forming unit includes a mixing chamber communicating with the outlet of a pump for the purpose of mixing liquid and air, and includes a dispensing part provided with an outflow channel with a foam opening for dispensing foam, wherein the outflow channel is in communication with the mixing chamber. Further, a first foam-forming element is included, arranged in the outflow channel such that the foam flowing through the outflow channel passes through the foam-forming element at least twice. The dispensing part is further provided with a spout element in which is located the final part of the outflow channel and the foam opening. Finally, the outflow channel includes a cavity after the first passage through the first foam-forming element, which cavity lies before the spout element as seen in flow direction.

14 Claims, 4 Drawing Sheets

FOAM FORMING UNIT

The invention relates to a foam-forming unit which comprises a mixing chamber for mixing liquid and air, a dispensing part provided with an outflow channel with a foam opening for dispensing foam, wherein the outflow channel is in communication with the mixing chamber, and a first foam-forming element arranged in the outflow channel such that the foam flowing through the outflow channel passes through the foam-forming element at least twice, wherein the dispensing part is further provided with a spout element in which is located the final part of the outflow channel and the foam opening.

Such a foam-forming unit is known from EP 1 199 105. Arranged in the spout element is the foam-forming element through which the foam passes twice on its way to the foam opening in the spout element. The dimensions of the foam-forming element are limited by the limited internal dimensions of the spout element.

The invention has for its object to provide an improved foam-forming unit. A further object of the invention is to provide a foam-forming unit with which a foam of the highest possible quality can be produced, i.e. air bubbles in the foam being as fine and as uniform as possible.

The present invention provides for this purpose a foam-forming unit of the type described in the introduction, wherein the outflow channel comprises a cavity after the first passage through the first foam-forming element, which cavity lies before the spout element as seen in flow direction.

The space in the cavity, which the foam enters when it has passed through the first foam-forming element for a first time, can be readily adjusted in respect of dimensions. The cavity lies under the cap of the dispensing part which, from a production engineering viewpoint, can be easily adapted to the desired situation. The cavity, and thereby the counter-pressure, is important in creating a resistance whereby the foam is as it were forced to pass through the foam-forming element at a determined speed. The ability to vary the counter-pressure is important in respect of the application of diverse liquids for pumping. The quality of the foam can therefore be further influenced in a simple manner by the correct choice of the dimensions of the cavity.

Because the foam flowing through the outflow channel passes through the foam-forming element twice, a finer and more uniform foam is found to result. In addition, the production process is relatively simple, since only one foam-forming element is arranged for two passages, which has the effect of saving costs.

In a preferred embodiment a screen foam-forming element is arranged in the outflow channel before the first foam-forming element. This is found to further improve the quality of the dispensed foam.

In a preferred embodiment the foam-forming element comprises a screen. A screen is found to produce the desired foam-forming effect.

In a further embodiment the foam-forming element comprises a mixing element in addition to or instead of a screen. A screen has the object of reducing the particle size, while a mixing element brings about a mixing or swirling of the foam.

In a preferred embodiment the openings in the second screen have a dimension between 0.1 mm and 0.4 mm, and preferably in the order of 0.2 mm. Tests have shown that these dimensions produce the desired results.

In a preferred embodiment the first screen has openings with a dimension between 10 μm and 150 μm, and preferably in the order of 50 μm. Tests have shown that these dimensions produce the desired results.

The foam-forming unit further comprises a pump for liquid and a pump for air, which are each provided with an inlet and an outlet.

In a preferred embodiment the foam-forming unit comprises valves in the inlet and the outlet of each pump for drawing in respectively expelling air and liquid, wherein one or more valves are formed integrally with the air pump or liquid pump into a single construction element. Integral forming of the valves reduces the number of components and production steps and saves costs.

In a preferred embodiment the outflow channel comprises, after the first passage through the first screen, a cavity comprising side walls and an upper wall with a predetermined height relative to the first screen. As explained above, the dimension of the cavity is found in practice to be important in producing foam of a higher quality.

In a further preferred embodiment the predetermined height is between 1 mm and 4 mm, and preferably in the order of 2 mm. With such dimensions the foam-forming unit is found in practice to produce finer and more uniform foam.

In a further preferred embodiment a cap forms the walls of the cavity. The cap is simple to arrange and enables a greater variety in the product, including variation in colour and material choice.

In a further preferred embodiment the inlet of the pump for air comprises at least one opening for drawing in air in an outer wall of the foam-forming unit. Owing to this location of the air opening the foam-forming unit can also be used in a wet environment, such as a shower, without water interfering with the operation.

In a further preferred embodiment the above mentioned opening communicates with a space in which a tube, which communicates with an air reservoir of the air pump, protrudes over a predetermined length. Owing to such an air inlet the foam-forming unit will continue to function in a wet environment such as a shower. The opening can also be relatively small and therefore inconspicuous.

According to a further aspect, the present invention provides a foam dispensing assembly consisting of a liquid container and a foam-forming unit, wherein the foam-forming unit is formed by a foam-forming unit as described above.

The invention will now be further elucidated with reference to the annexed drawings. In the drawings.

Figure 1:
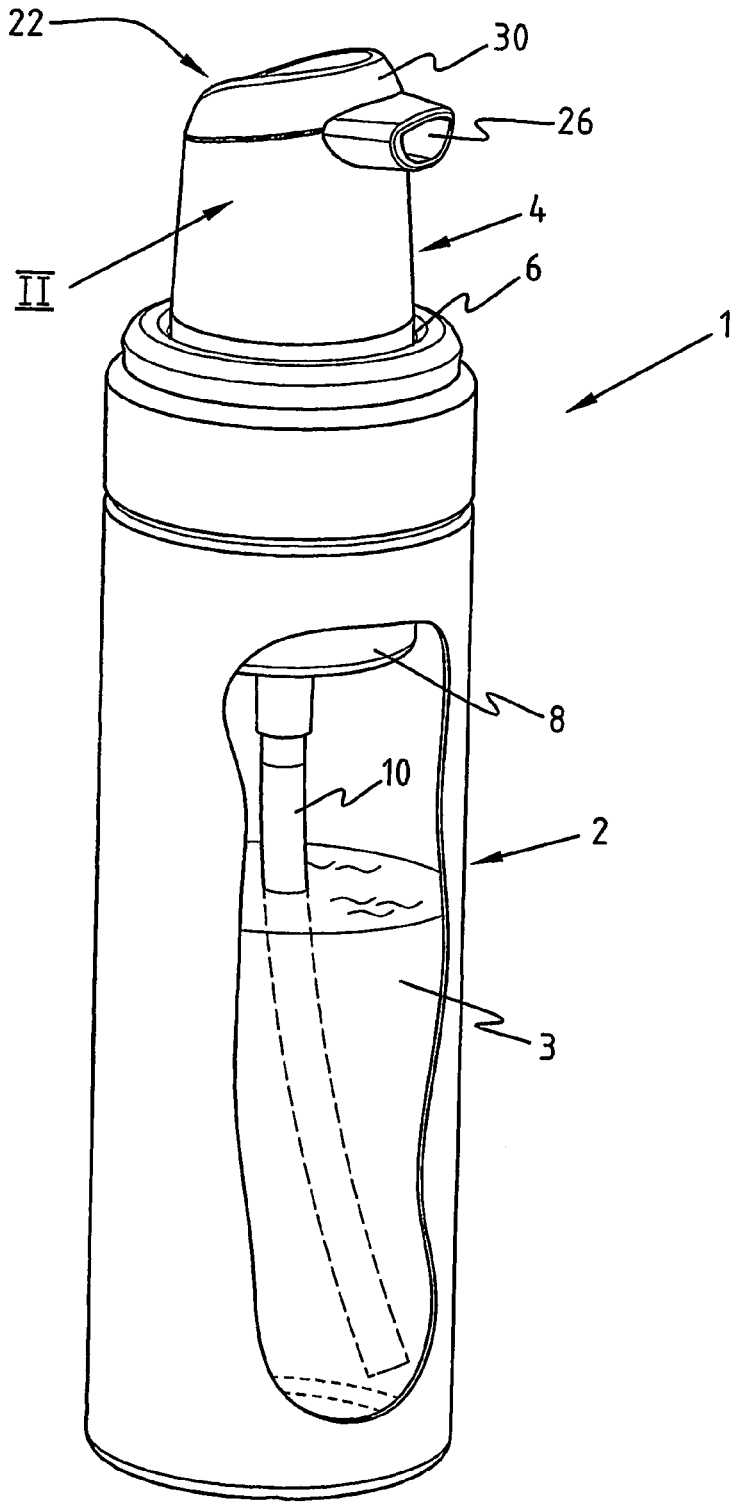
FIG. 1 shows a perspective, partly cut-away foam dispensing assembly according to the invention.

A foam dispensing assembly 1 according to the present invention comprises a cylindrical liquid container 2 which has therein a liquid 3 for foaming and on which is arranged a foam-forming unit 4 (FIG. 1). Foam-forming unit 4 comprises a pump 6 for air and a pump 8 for liquid, which are each provided with an inlet and outlet. Inlet 9 of air pump 6 is in communication with the environment (FIG. 2), while the inlet of liquid pump 8 is in communication with the content 3 of liquid container 2 via hose 10. Foam-forming unit 4 further comprises a mixing chamber 12 which is in communication with outlet 14 of air pump 6 and the outlet of liquid pump 8 comprising valve 16. Valve 18 is further arranged close to the outlet of the air pump.

Figure 2:
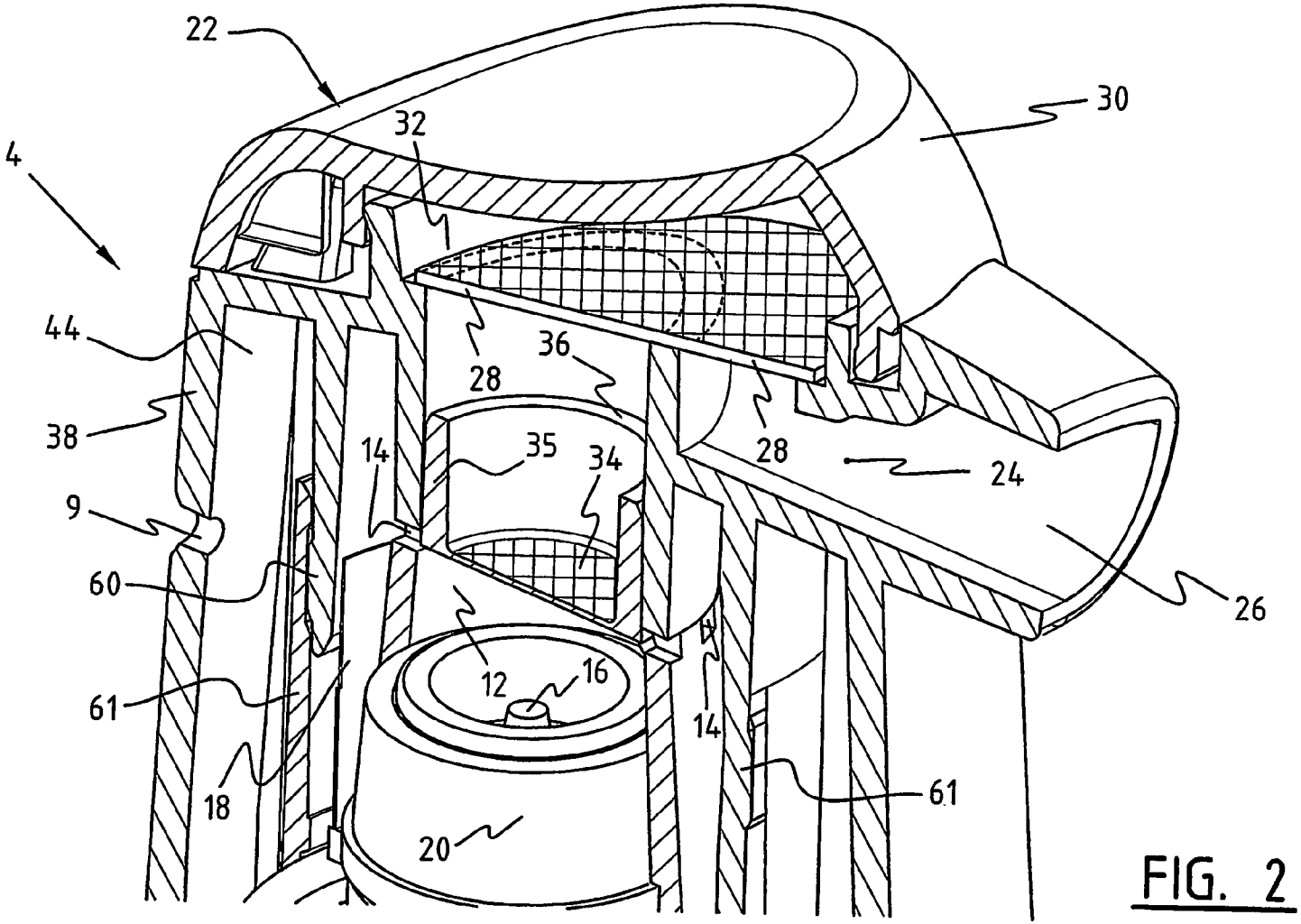
FIG. 2 shows a perspective view in cross-section of a detail of a foam-forming unit according to the present invention.

The top part of the assembly comprises a dispensing part 22, comprising an outflow channel 24 with a foam opening 26 (FIG. 2). Outflow channel 24 runs from mixing chamber 12 to foam opening 26. In this channel 24 are arranged foam-forming elements, in the embodiment shown in FIG. 2 in the form of relatively fine-mesh screens 34,28.

A first screen 28 is arranged by means of ultrasonic welding such that the foam passes through screen 28 twice. Arranged for this purpose above screen 28 is a cap 30 which forms a cavity 32 above screen 28. As seen in the flow direction, cavity 32 is located before spout element 51. The upper wall of cap 30 is curved for the purpose of simple and ergonomic operation. The minimum height, i.e. the distance between cap 30 and screen 28, is about 2 mm, which tests have shown to be an advantageous height for finer and more uniform foam. Screen 28 has openings with a dimension between 10 μm and 150 μm, and preferably in the order of 50 μm. Cap 30 is a separate component of the foam-forming unit, which makes possible a variation in colour and material thereof.

In the shown preferred embodiment a second screen 34 is further arranged in the outflow channel before the first screen, which has openings with a dimension between 0.1 mm and 0.4 mm, and preferably in the order of 0.2 mm. The second screen 34 is arranged by injection moulding and is formed integrally with a ring 35 which forms part of construction component 61. Two components of the foam-forming unit are thus integrated, thereby reducing the cost price and assembly time.

The mixture of liquid and air leaves the mixing chamber 12 via second screen 34, wherein foam is formed with a relatively coarse structure. The coarse foam then passes through the first screen 28 and enters cavity 32, wherein the structure of the foam becomes finer and more uniform, i.e. air bubbles in the foam are of smaller and more uniform size. The foam then passes through screen 28 a second time and approaches outflow opening 26, wherein the foam becomes even finer and more uniform.

The quality of the foam is higher than in known foam-forming units, which often also comprise two screens. In addition, only one production step is necessary to arrange the first screen, so that production costs are still about the same as for known foam-forming units. For a further improvement in the foam quality, a third screen (not shown) can be arranged on edge 36.

Figure 3:
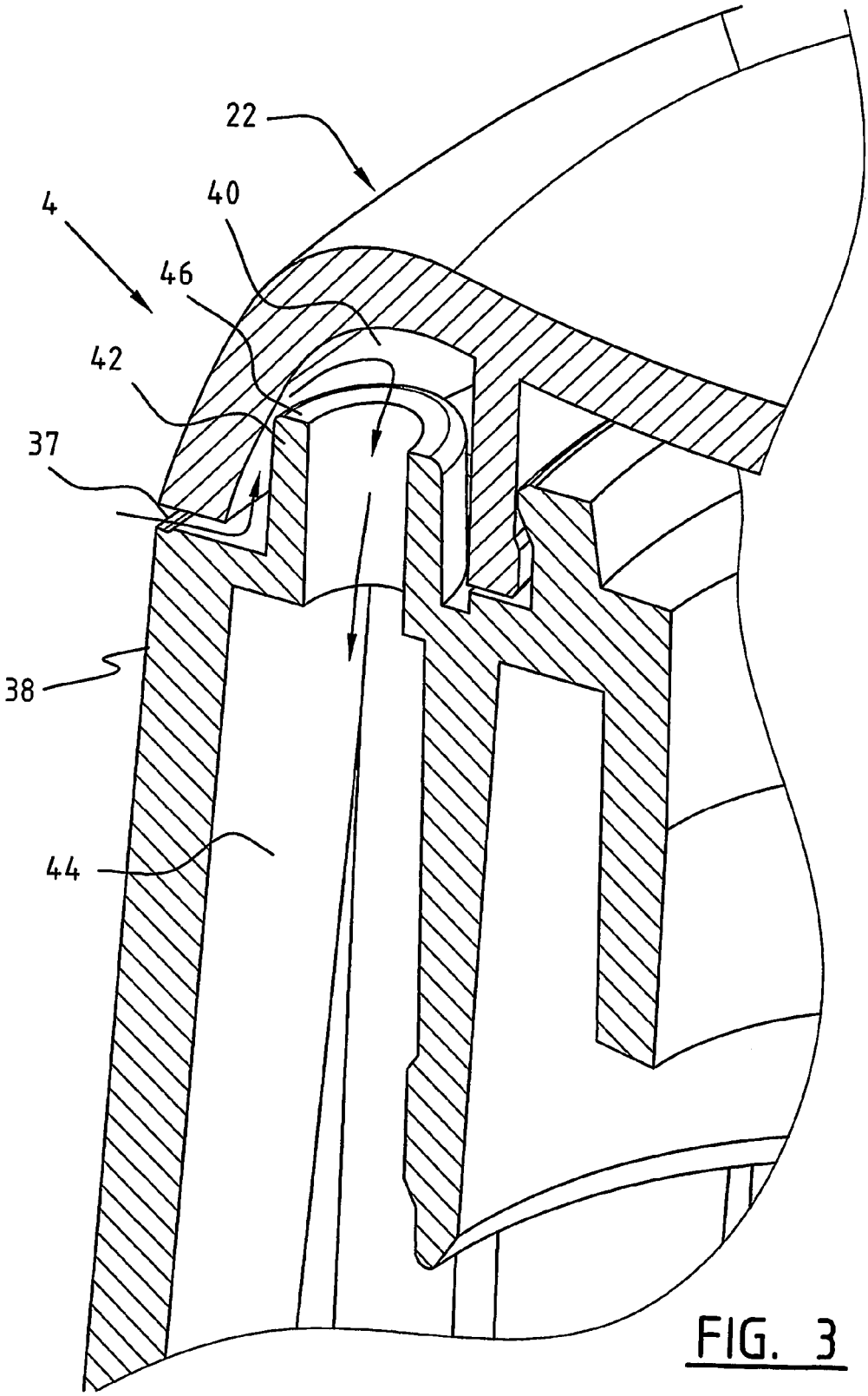
FIG. 3 is a partly cut-away detail view of the foam-forming unit of FIG. 2.

In a further preferred embodiment the air inlet of the air pump is formed by a gap 37 arranged between cap 30 and wall 38 (FIG. 3). Air is drawn in and enters space 40 into which debouches a tube 42, which serves as a chimney and allows the air through to air chamber 44 for the air pump. The upper end 46 of tube 42 is preferably angled, wherein the angle with the longitudinal axis of the tube is about 30°. Tube 42 protrudes over a predetermined length of about 4 mm into space 40. The construction thus acts as an enclosed chimney. This air inlet has the advantage that in a wet environment hardly any water is drawn in, so that the foam-forming unit also continues to function under the shower.

Figure 4:
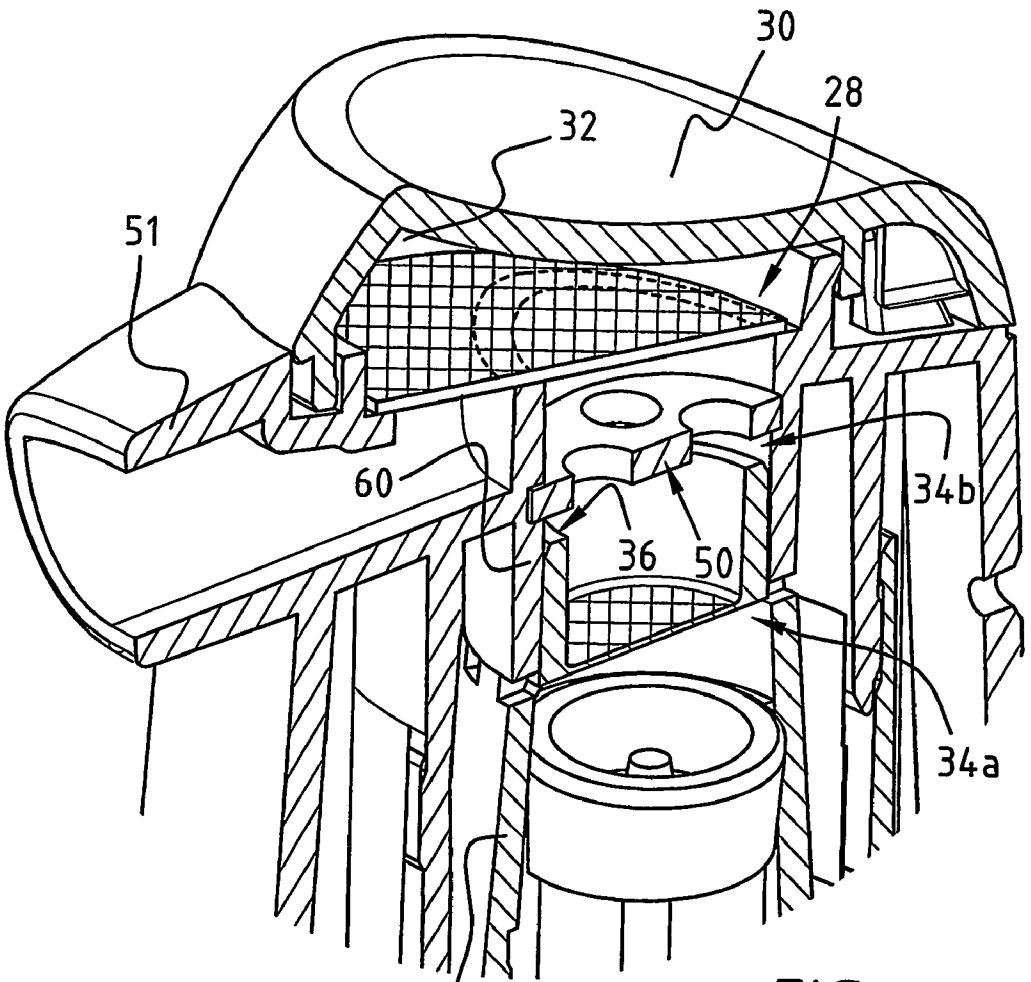
FIG. 4 is a perspective view in cross-section of a detail of a foam-forming unit according to a second embodiment.

FIG. 4 shows a second embodiment of a foam-forming unit according to the invention. The embodiment is largely identical to the first embodiment shown in FIG. 2, with the difference that a further foam-forming element in the form of a mixing element 50 is placed in outflow channel 24. Mixing element 50 is arranged between first foam-forming element 28 and second foam-forming element 34*a*. Mixing element 50 consists of a plate-like element which is co-moulded with construction component 60 and which is provided with four circular holes with a cross-section of about 1.5 mm. The pattern and dimensions of the openings in mixing element 50 can be varied subject to the product for pumping. An additional second foam-forming element 34*b* can be further provided (location of this element is shown in FIG. 4).

It is noted that the second foam-forming element 34*a* is preferably co-moulded with construction component 61. The additional second foam-forming element 34*b* is preferably welded to the upper side of construction component 61. The first foam-forming element 28 is preferably also welded to the upper edge 36 of construction component 60. The foam-forming unit consists substantially of only three construction components 60, 61 and 32.

The further operation of the above described foam-forming unit 4 and assembly 1 is described in the international patent application 0 242 005 of applicant. The content thereof is incorporated herein.

The system has a variable arrangement, wherein a number of options are available for adapting the foam-forming unit to a specific liquid. Because there are very diverse liquids (viscosity, tixotropic behaviour, chemical composition, the presence of particles etc.), there is a system arrangement wherein the construction can be modified relatively easily to the liquid for pumping. The variables are, among others, number, pattern and size of the openings in the or each foam-forming element, the number of foam-forming elements, which foam-forming elements (screen or mixing element), dimensions of cavity 32 and so on.

The present invention is not limited to the above described preferred embodiments thereof, in which many modifications can be envisaged, but is defined by the scope of the appended claims.

The invention claimed is:

1. Foam-forming unit, comprising:

a mixing chamber communicating with the outlet of a pump for the purpose of mixing liquid and air, a dispensing part provided with an outflow channel with a foam opening for dispensing foam, the outflow channel being in communication with the mixing chamber, a first foam-forming element arranged in the outflow channel such that the foam flowing through the outflow channel passes through the foam-forming element at least twice, the dispensing part further including a spout element in which is located the final part of the outflow channel and the foam opening, and the outflow channel including a cavity after the first passage through the first foam-forming element, the cavity lying before the spout element as seen in flow direction, and a second foam-forming element arranged in the outflow channel.

2. Foam-forming unit as claimed in claim 1, wherein the first foam-forming element comprises a screen.

3. Foam-forming unit as claimed in claim 1, wherein the first foam-forming element comprises a mixing element.

4. Foam-forming unit as claimed in claim 1, further comprising a pump for liquid and a pump for air, which are each provided with an inlet and an outlet.

5. Foam-forming unit as claimed in claim 4, comprising valves in the inlet and the outlet of each pump for drawing in respectively expelling air and liquid, wherein one or more valves are formed integrally with the air pump or liquid pump into a single construction element.

6. Foam-forming unit as claimed in claim 2, wherein the screen of the first foam-forming element has openings with a dimension between 10 μm and 150 μm.

7. Foam-forming unit as claimed in claim 2 wherein openings in the second foam-forming element have a dimension between 0.1 mm and 0.4 mm.

8. Foam-forming unit as claimed in claim 1, wherein the outflow channel comprises after the first passage through the first foam-forming element a cavity comprising side walls and an upper wall with a predetermined height relative to the first foam-forming element.

9. Foam-forming unit as claimed in claim 8, wherein the predetermined height is between 1 mm and 4 mm.

10. Foam-forming unit as claimed in claim 8, wherein a cap forms the walls of the cavity and wherein the upper wall is curved.

11. Foam-forming unit as claimed in claim 10, wherein the cap is arranged on inner walls of the foam-forming unit in order to form the cavity.

12. Foam-forming unit as claimed in claim 4, wherein the inlet of the pump for air comprises at least one opening for drawing in air in an outer wall of the foam-forming unit.

13. Foam-forming unit as claimed in claim 12, wherein the opening for drawing in air is in communication with a space in which a tube, which communicates with an air reservoir of the air pump, protrudes over a predetermined length.

14. A foam dispensing assembly, comprising:

a liquid container having an opening; and a foam-forming unit attached to an opening of the liquid container, the foam-forming unit comprising:

a liquid pump;

an air pump;

a mixing chamber in communication with the liquid pump and the air pump;

a dispensing part having a foam opening;

an outflow channel in communication with the mixing chamber and the foam opening;

a first screen arranged in the outflow channel such that a foam flowing from the mixing chamber to the foam opening passes through the first screen twice; and a second screen arranged in the outflow channel before the first screen.

* * * * *